US010219969B2

(12) United States Patent
Yu

(10) Patent No.: US 10,219,969 B2
(45) Date of Patent: Mar. 5, 2019

(54) ELECTRIC WALKING AID AND CONTROL METHOD THEREOF

(71) Applicant: NATIONAL YANG-MING UNIVERSITY, Taipei (TW)

(72) Inventor: Chung-Huang Yu, Taipei (TW)

(73) Assignee: NATIONAL YANG-MING UNIVERSITY, Taipei (TW)

( * ) Notice: Subject to any disclaimer, the term of this patent is extended or adjusted under 35 U.S.C. 154(b) by 102 days.

(21) Appl. No.: 15/366,466

(22) Filed: Dec. 1, 2016

(65) Prior Publication Data

US 2017/0273854 A1 Sep. 28, 2017

(30) Foreign Application Priority Data

Mar. 24, 2016 (TW) ..... 105109147 A

(51) Int. Cl.
*A61H 3/04* (2006.01)
*A61H 3/00* (2006.01)

(52) U.S. Cl.
CPC ..... *A61H 3/04* (2013.01); *A61H 2003/006* (2013.01); *A61H 2003/043* (2013.01); *A61H 2201/5007* (2013.01); *A61H 2201/5023* (2013.01); *A61H 2201/5064* (2013.01); *A61H 2201/5092* (2013.01)

(58) Field of Classification Search
CPC ..... A61H 3/04; A61H 2201/5064; A61H 2201/5023; A61H 2201/5007; A61H 2003/006; A61H 2201/5092; A61H 2003/043
See application file for complete search history.

(56) References Cited

U.S. PATENT DOCUMENTS

2006/0149338 A1* 7/2006 Flaherty ..... A61H 1/0255 607/49
2006/0197485 A1* 9/2006 Kawai ..... B62D 57/032 318/568.12
2010/0170546 A1* 7/2010 Popovic ..... A61H 3/008 135/67
2010/0193264 A1* 8/2010 Kurek ..... A61H 3/04 180/19.1
2011/0166753 A1* 7/2011 Yu ..... A61H 3/04 701/51
2016/0253890 A1* 9/2016 Rabinowitz ..... A61H 1/02 340/539.13
2016/0299502 A1* 10/2016 Chamberlain ..... G05D 1/0242
2016/0331626 A1* 11/2016 Fellingham ..... A61H 3/04
2017/0231856 A1* 8/2017 Karlovich ..... A61H 3/008 607/148
2017/0326019 A1* 11/2017 Bramsiepe ..... A61H 3/04
2017/0354564 A1* 12/2017 Dirauf ..... A61H 3/04

FOREIGN PATENT DOCUMENTS

DE 202012011634 U1 * 2/2013 ..... A61H 3/04

* cited by examiner

*Primary Examiner* — Jeffrey C Boomer
(74) *Attorney, Agent, or Firm* — Muncy, Geissler, Olds & Lowe, P.C.

(57) ABSTRACT

An electric walking aid and control method thereof are disclosed. A location of the electric walking aid, and a distance between the electric walking aid and the user, are dynamically controlled and adjusted to provide the user with static and dynamic support function, so as to support the user under static and dynamic situation of interaction between walk and stand, during the walking training process.

15 Claims, 1 Drawing Sheet

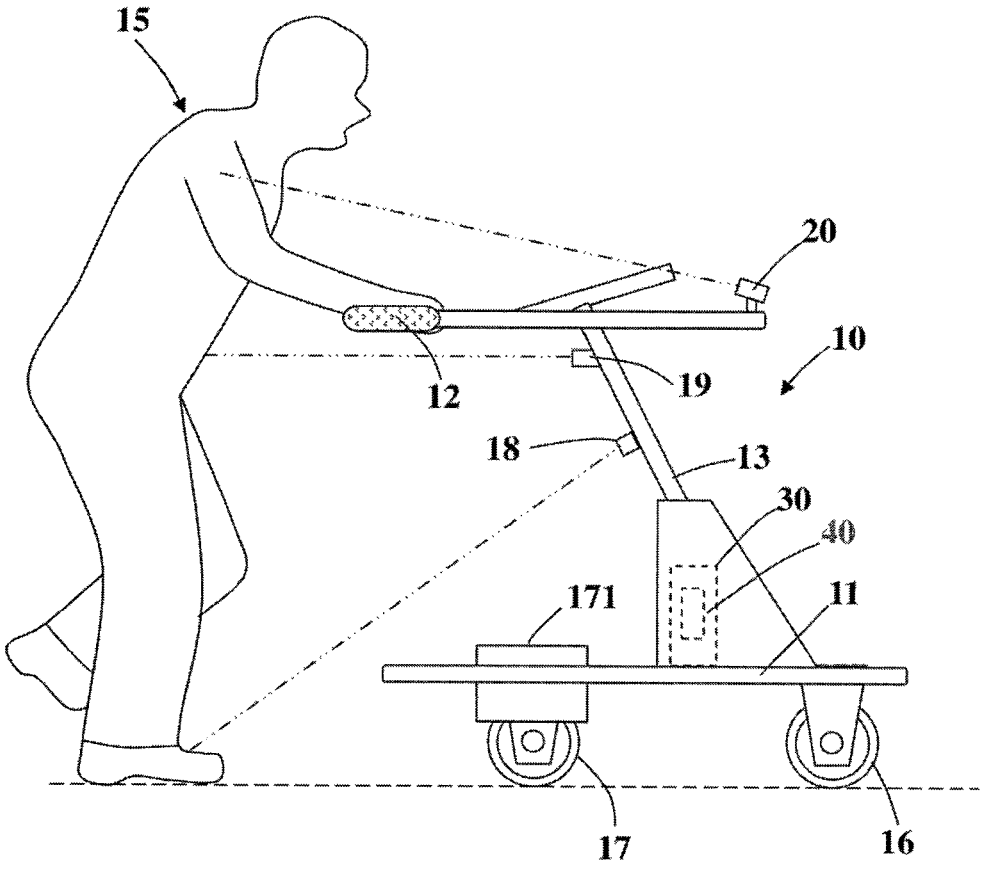
15
20
10
12
19
18
13
30
40
171
11
17
16

ELECTRIC WALKING AID AND CONTROL METHOD THEREOF

BACKGROUND OF THE INVENTION

1. Field of the Invention

The present disclosure relates to a walking aid technology, more particularly to an electric walking aid operated based on a distance from the user.

2. Description of the Related Art

Walking disorder is one of common clinical dysfunctions. After onset of injury of spinal cord, cerebral vascular accident, brain trauma or CNS disorder, varying degrees of sequela may be left to impact the patient's walk ability, for example, the sequela including paraplegia, hemiplegia, lower limb bone joint and muscle disease, joint dysfunction, decreased muscle strength, destruction of joint stability, or imbalance between strength of muscles. Impaired walking ability, which includes unable to walk, walking difficulty or abnormal gait, directly affects the patient's activities in daily life. The most urgent need of such patients is to improve the walking ability and provide appropriate support is the first step.

Electric walking aid is a training apparatus help patients improve walking ability. However, present electric walking aids only focus on the way to make patients walk and follow the aids, but fail to provide appropriate support for individual case of patient. This comes up with patients moving slower than the aids, and the unsafe condition happens due to the excessive spacing between patients and aids. On the other hand, cases that patients move faster than the aids, which leads to inadequate spacing between the patient and the aids, may also occur. The former situation with excessive spacing makes patients lean forward improperly, and the patients are prone to fall forward. The latter situation with inadequate spacing makes patients produce a deficient stride for normal steps. Some of the patients who thrown back may even fall backwards.

Therefore, it is pretty important to make electric walking aid available to adjust the distance between the aids and the patients according to the users individually and provide appropriate support. What is an appropriate support is to provide support when the patient has a need, but not support the user all the time. An appropriate support can let the users control their walking process and training on their own. When there are improper changes to the patients' walking pattern or position, the aids will provide support to the users, and further adjust the users' walking pattern and position. An appropriate support on one hand, improves the patients' safety while using the aids. On the other hand, appropriate support can help the patients adjust their position and provide appropriate walking spacing for the patients to walk. However, current electric walking aids don't have such functions.

SUMMARY OF THE INVENTION

An objective of the present disclosure is to dynamically control and adjust a distance between an electric walking aid and a user, to locate the electric walking aid at an appropriate location for the patient's walking status or stand status, so as to support the user under static and dynamic situations with interaction between walk and stand, during the walking training process.

In the aid of the present disclosure, a moving device is configured to move the aid forwardly or backwardly. The forward direction is a direction straightly away from the user, and the backward direction is a direction straightly close to the user. The aid includes a gait sensing device, an abdomen position sensing device, a shoulder position sensing device and an analysis module. The gait sensing device is configured to sense the user's feet in a non-contact manner and output a gait characteristic message of the user. The abdomen position sensing device is configured to sense an abdomen position of the user and output an abdomen position characteristic message of the user. The shoulder position sensing device is configured to sense a shoulder position of the user. The analysis module is configured to collect and integrate parameters of the messages outputted from the gait sensing device, the abdomen position sensing device and the shoulder position sensing device, and analyze the parameters to output characteristic messages associated with a location of center of gravity of the user, a support base area, whether the user located within the user area, the user's upper body inclining forwardly, and the user's upper body inclining backwardly.

The electric walking aid further includes a control system electrically connected to the motor, the gait sensing device, the abdomen position sensing device, the shoulder position sensing device and the analysis module, and configured to perform an algorithmic program according to at least one of the characteristic messages and at least one preset parameter to obtain a calculation result, and then control the aid to move according to the calculation result. Therefore, the aid can implement two support modes and three moving modes.

The support modes include a first support mode (hereafter, abbreviated as R1 mode), and a second support mode (hereafter, abbreviated as R2 mode).

The moving modes include instant track modes (hereafter, abbreviated as M3A mode and M3B mode), stable feet modes (hereafter, abbreviated as M4A mode and M4B mode), and a posture correcting mode (hereafter, abbreviated as PPC mode). The aid provides dynamic support during the walking of the user in the dynamic support modes.

An operation interface of the control system shows the support modes and the moving modes for a therapist to select. The therapist selects one of the support modes and one of the dynamic support modes according to the user's current stand and walking conditions or a desired treatment goal, so that the user can be supported while walking and standing alternatively.

The R1 mode is suitable to the user (such as Parkinson's disease patient) who has the upper body inclining forwardly and requires almost the same distances away from the aid while standing and walking alternatively. By means of automatically adjusting the relative distance and location of the aid from the user, the aid can provide static and dynamic support to the user while the user stands and walks.

The R2 mode is suitable for the user who requires a larger distance away from the aid while walking than while standing. For example, the minor stroke patient having a step length approaching to normal, or the convalescent stroke patient. By means of automatically moving the aid to increase the distance between the aid and the user, a larger space can be formed for the user to conveniently step. While the user stands, the aid is automatically moved close to the user to provide the static support.

In the M3A and M3B mode, the moving speed of the aid is controlled and adjusted in real time according to the distance between the user and the aid while the user is walking, so the M3A and M3B modes are suitable for the user capable of continuously walking.

In the M4A and M4B modes, the aid is kept still while the user is walking, and starts to move for a predetermined distance while the user's feet land stably during walking. The M4A and M4B modes are suitable for the user unable to continuously walk and requiring the highly stable support.

In the PPC mode, the location of the aid is adjusted according to the user's forward-inclined posture or backward-inclined posture, so that the aid can dynamically adjust its relative location to support the user and further correct the user's forward-inclined posture or backward-inclined posture to a normal upright posture.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

The FIGURE is a schematic view of the electric walking aid of the present disclosure.

DETAILED DESCRIPTION OF THE PREFERRED EMBODIMENTS

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Please refer to the FIGURE. In the present disclosure, an electric walking aid (hereafter, abbreviated as "the aid") includes a main structure 10, a moving device, a drive wheel 17, a gait sensing device 18, an abdomen position sensing device 19, a shoulder position sensing device 20, an analysis module 40 and a control system 30.

The main structure 10 includes a base 11, a pair of armrests 12 and a support member 13 connected between the base 11 and the armrests 12. The main structure 10 further defines a user area for accommodating a user 15.

A moving device disposed in the main structure and configured to control the aid to move. In the present invention, the moving device is the direction wheel 16 and the drive wheel 17 are respectively disposed at a front part and a rear part of the base 11. The drive wheel 17 is controlled by a motor 171. A ratio of numbers of the direction wheel 16 to the drive wheel 17 can be 1:2, 2:1, or 2:2. In the embodiment of the present disclosure, the drive wheel 17 is a rear wheel of the aid for stable linear movement. The direction wheel 16 and the drive wheel 17 are presented in order to illustrate but not limit the present invention.

The gait sensing device 18 is disposed in the main structure 10 and configured to sense the user's feet in a non-contact manner and output a gait characteristic message of the user. The gait characteristic message may include, not limited thereto, a step frequency, a step length, a step speed, a step position, and a straight-line distance between a specific point of the main structure 10 and an intermediate point between the centers of the user's two soles. Hereafter, this straight-line distance refers to as a first distance d1. Preferably, the non-contact manner can be one of an imaged-based manner, a laser-based manner, an infrared-based manner and an ultrasonic-based manner; however, the present disclosure is not limited thereto.

The abdomen position sensing device 19 is disposed in the main structure, and configured to sense an abdomen position of the user and output an abdomen position characteristic message of the user. The abdomen position characteristic message includes, not limited to, a straight-line distance between the specific point of the main structure to a specific point of the user's abdomen. Hereafter, this straight-line distance refers to as a second distance.

The shoulder position sensing device 20 is disposed in the main structure 10 and configured to sense a shoulder position of the user.

The analysis module 40 is configured to collect and integrate parameters of the messages outputted from the gait sensing device 18, the abdomen position sensing device 19 and the shoulder position sensing device 20, and analyze the parameters to output characteristic information associated with a location of center of gravity of the user, a support base area, whether the user located within the user area, the user's upper body inclining forwardly, and the user's upper body inclining backwardly, and so on.

The control system 30 is electrically connected to the motor 171, the gait sensing device 18, the abdomen position sensing device 19, the shoulder position sensing device 20 and the analysis module 40. The control system 30 is configured to perform an algorithmic program according to at least one of the characteristic messages and at least one preset parameter to obtain a calculation result, and then control activation, rotational speed, forward rotation, reverse rotation, and stop of the motor according to the calculation result. The at least one preset parameter can be built in the control system 30, or a therapist can input the at least one preset parameter through an operation interface of the control system in advance. The motor 171 is configured to control rotation of the drive wheel 17, so that the aid can be controlled to move.

In operation status, the aid of the present disclosure is controlled by the control system 30 to have two supporting modes and three moving modes. In the present disclosure, the operation status of the aid is established only when the user is located in the user area of the aid. The control system 30 and the aid are not activated or are stopped action until the operative status is established.

The support modes include a first support mode (R1 mode) and a second support mode (R2 mode). The moving modes include instant track modes (M3A mode and M3B mode), and stable feet modes (M4A mode and M4B mode), and a posture correcting mode (PPC mode). In one of the moving modes, the aid of the present disclosure dynamically supports the user during walking. The supporting modes and the moving modes are shown on an operation interface of the control system 30 as options for the therapist to select. According to the user's current stand and walk condition or a desired treatment goal, the therapist selects one of the supporting modes and one of the moving modes, so that the user can be supported by the aid under static and dynamic situation of interaction between walk and stand, during the walking training process.

In the R1 mode, the aid and the control system thereof executes following control steps.

In a first step, the aid is stopped moving and the user is in a stand status, and the control system senses a first distance d1.

In a second step, according to the first distance d1 and a neutral distance dzn preset in the control system, the control system determines whether |d1-dzn| is larger than dε. The dε is a tolerable error value, and the dε and dzn are built in the control system or inputted by the therapist through the operation interface of the control system. If |d1-dzn| is larger than dε, the control system controls the aid to move until the comparison result means that |d1-dzn| is smaller than dε.

The R1 mode is suitable to the user (such as Parkinson's disease patient) who has the upper body inclining forwardly and requires almost the same distances away from the aid while standing and walking both. By means of automatically adjusting the relative distance and location of the aid from the user, the aid can provide the static and dynamic support to the user while the user stands and walks.

The step to set the R1 mode: while the aid is executing one of the M3A, M3B, M4A, M4B modes, if the user stands and the aid is stopped moving, the control system is switched to execute the R1 mode, so that the aid can automatically adjust its relative distance and location from the user, and provide the static support to the user while the user stands.

In the R2 mode, the aid and the control system thereof executes following control steps.

In a first step, the control system shifts a neutral section Zn away from the user by a preset distance, so as to form a forward neutral zone. The neutral zone Zn can be built in the control system, or the therapist can set coordinates of a zone on the operation interface of the control system to input the neutral zone Zn in advance. The neutral zone Zn represents the location boundary of the user. The preset distance can be built in the control system, or the therapist can set a coordinate on the operation interface of the control system to input the preset distance in advance.

In a second step, the control system controls the aid to move into the forward neutral zone Zn defined in the first step of the R2 mode, to form a larger space between the aid and the user, so that the user can step easily to train walking.

In a third step, the control system controls the aid to execute one of the M3A, M3B, M4A, and M4B modes.

In a fourth step, while the aid is stopped moving and the user stands, the control system shifts the forward neutral zone back to the user by the preset distance, to recovery the neutral zone. The preset distance is built in the control system, or the therapist can set coordinate on the operation interface of the control system to input the preset distance in advance.

In a fifth step, the control system controls the aid to move back the neutral zone defined in the fourth step of the R2 mode, so that the aid is closer to the user to provide the static support conveniently.

The R2 mode is suitable for the user who required a larger distance away from the aid while walking than while standing. For example, the minor stroke patient having a step length approaching to normal, or the convalescent stroke patient. By means of automatically moving the aid to increase the distance between the aid and the user, the space can be formed for the user to conveniently step. While the user stands or walks, the aid is automatically moved close to the user to provide the support.

In the M3A mode, the aid and the control system thereof execute following control steps.

In a first step, the control system senses the first distance d1.

In a second step, the control system performs comparison on the first distance d1, and an upper limit dznu and a lower limit dznl of the neutral zone Zn. The upper and lower limits dznu and dznl are built in the control system or inputted by the therapist through the operation interface of the control system in advance.

In a third step, if the d1 is larger than the dznu, it indicates that the user walks slower or backwardly, so the control system controls the motor to slightly decelerate or rotate backwardly, to move the aid close to the user until d1<dznu and d1>dznl both are satisfied. When the d1 is smaller than the dznl, it indicated that the user walks faster or forwardly, so the control system controls the motor to slightly accelerate or rotate forwardly, to move the aid away from the user until d1<dznu and d1>dznl both are satisfied. When the d1 is smaller than the dznu and larger than the dznl, it indicates that the locations of the aid and the user correspond to each other.

The first, second, and third steps of the M3A mode are repeated until the walk training is ended or the aid is turned off because of occurrence of the emergency condition.

In the M3B mode, the aid and the control system thereof execute following steps.

In a first step, the control system obtains the first distance d1, max(d1-left, d1-right) and min(d1-left, d1-right) from the gait sensing device 18. A value of (d1-left) is a straight-line distance between the foot of the user's left leg and the specific point of the main structure (that is, the specific point of the aid), and a value of (d1-right) is a straight-line distance between the foot of the user's right leg and the specific point of the main structure.

In a second step, the control system performs comparison on the first distance d1, the upper limit dznu and the lower limit dznl of the neutral zone Zn. The dznu and dznl are built in the control system, or inputted by the therapist through the operation interface of the control system. The control system compares the second distance d2 with max(d1-left, d1-right) and min(d1-left, d1-right).

In a third step, when the d2 is larger than the dznu and d2 is between min(d1-left, d1-right) and max(d1-left, d1-right), it indicates that the user's abdomen characteristic is located between the user's two legs and the user walk slower or backwardly, so the control system controls the aid to move slower to reduce the distance between the aid and the user until d2 <dznu and d2 >dznl are satisfied. When d1 is smaller than dznl and d2 is between min(d1-left, d1-right) and max(d1-left, d1-right), it indicates that the user's abdomen characteristic is still located between the user's two legs and the user walks faster or forward, so the control systems controls the motors to slightly accelerate or rotate forwardly according to change of the distance d2 , so as to move the aid faster to increase the distance between the aid and the user until d2 <dznu and d2 >dznl are satisfied.

In a fourth step, the first, second, third steps of the M3B mode are repeated until the walk training is ended or the aid is turned off because of occurrence of the emergency condition.

In the M3A and M3B mode, the moving speed and location of the aid relative to the user is controlled and adjusted in real time according to the distance between the user and the aid during walking. The M3A and M3B modes are suitable for the user capable of continuously walking.

In the M4A mode, the aid and the control system thereof execute following steps.

In a first step, the control system controls the aid to keep static.

In a second step, the control system obtains the user's step speed from the gait sensing device.

In a third step, according to the data from the gait sensing device, the control system determines whether the user's feet stably land; if no, the first step of the M4A mode is executed. If yes, a fourth step of the M4A mod is executed.

In the fourth step, the control system obtains the first distance d1.

In a fifth step, the control system compares the first distance d1, with the upper limit dznu and lower limit dznl of the neutral zone Zn. The dznu and dznl are built in the control system, or inputted by the therapist through the operation interface of the control system in advance.

In a sixth step, when the d1 is larger than the dznu, the control system controls the aid to move close to the user in a preset speed or a speed equivalent to the user's step speed, and the control system controls the aid to stop moving when the d1 is smaller than the dznu and the d1 is larger than the dznl; otherwise, when the d1 is smaller than the dznl, the control system controls the aid to move away from the user in the preset speed or the speed equivalent to the user's step speed, and the control system controls the aid to stop moving when d1 is smaller than dznu and d1 is larger than dznl.

The first through sixth steps of the M4A mode are repeated until the walk training is ended or the aid is turned off because of the occurrence of the emergency condition.

In the M4B mode, the aid and the control system thereof execute following steps.

In a first step, the control system controls the aid to keep static.

In a second step, the control system obtains the user's step speed from the gait sensing device.

In a third step, according to the data from the gait sensing device, the control system determines whether the user's feet stably land; if not, the first step of the M4B mode is executed. If yes, a fourth step of the M4B mode is executed.

In the fourth step, the control system obtains the first distance d1, max (d1-left, d1-right) and min(d1-left, d1-right) from the gait sensing device 18. The value of (d1-left) is a straight-line distance between the foot of the user's left leg and the specific point of the main structure (that is, the specific point of the aid), the value of (d1-right) is a straight-line distance between the foot of the user's right leg and the specific point of the main structure.

In a fifth step, the control system compares the first distance d1with the upper limit dznu and the lower limit dznl of the neutral zone Zn. The dznu and dznl are built in the control system, or inputted by the therapist through the operation interface of the control system. The control system compares the second distance d2 with max(d1-left, d1-right) and min(d1-left, d1-right).

In a sixth step, when the d2 is larger than dznu and d2 is between min(d1-left, d1-right) and max(d1-left, d1-right), it indicates that the user's abdomen characteristic is located between two legs, the control system controls the aid to move close to the user in the preset speed or the speed equivalent to the user's step speed, and then stops movement of the aid when d2 is smaller than dznu and d2 is larger than dznl. When d2 is larger than dznl and d2 is between min(d1-left, d1-right) and max(d1-left, d1-right), it indicates that the user's abdomen characteristic is located between two legs, the control system controls the aid to move away from the user in the preset speed or the speed equivalent to the user's step speed, and then stops movement of the aid when d2 is smaller than dznu and d2 is larger than dznl.

In a seventh step, the second through sixth steps of the M4B mode are repeated until the walk training is ended or the aid is turned off because of occurrence of the emergency condition.

In M4A or M4B mode, the aid is kept static during the walking of the user, and started to move a preset distance when the user's feet land stably during the walking. Therefore, the aid in the M4A or M4B mode is applicable to the user who is unable to continuously walk and requires highly stable support.

In the PPC mode, the aid and the control system thereof execute following steps.

In a first step, the aid is moved according to the M3A, M3B, M4A or M4B mode.

In a second step, if the control system obtains the message associated with the user's upper body inclining forwardly, a third step of the PPC mode is executed; if the control system obtains the message associated with the user's body inclining backwardly, a fourth step of the PPC mode is executed.

In the third step of the PPC mode, the control system controls the aid to slightly decelerate or move backwardly (relative to the user), to support the user's upper body from a forward-inclined posture to an upright posture until the control system does not receive the message associated with the upper body inclining forwardly or backwardly.

In the fourth step of the PPC mode, the control system controls the aid to move forwardly (that is, away from the user) or slightly accelerate, so as to support the user's upper body from a back-inclined posture to the upright posture until the control system does not receive the message associated with the upper body inclining forwardly or backwardly.

In the PPC mode, the control system adjusts the location and speed of the aid according to the user's forward-inclined posture or back-inclined posture, so as to support the user and further correct the user's forward-inclined posture or back-inclined posture to the normal upright posture.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An electric walking aid, configured to operate based on a distance between a user and the electric walking aid, and the electric walking aid comprising:

a main structure comprising a base, a pair of armrests, and a support connected between the base and the armrests, and the main structure defining a user area for accommodating a user;

a moving device disposed in the main structure and configured to control the electric walking aid to move, wherein the moving device comprising at least one direction wheel and at least one drive wheel, which at least one drive wheel is controlled by a motor;

a gait sensing device disposed in the main structure and configured to sense the user's feet and output a gait characteristic message of the user by a non-contact manner, and wherein the gait characteristic message comprises a step frequency, a step length, a step speed, a step position and a first distance d1, and the first distance d1 is a straight-line distance between a specific point of the main structure and an intermediate point between the centers of the user's two soles;

an abdomen position sensing device disposed in the main structure, and configured to sense an abdomen position of the user and output an abdomen position characteristic message which contains a second distance d2 defined by a straight-line distance between the specific point of the main structure to a specific point of the user's abdomen;

a shoulder position sensing device disposed in the main structure and configured to sense a shoulder position of the user and output a shoulder position characteristic message;

an analysis module configured to collect and integrate parameters of the messages outputted from the gait sensing device, the abdomen position sensing device and the shoulder position sensing device, and analyze the parameters to output characteristic messages associated with a location of center of mass of the user, a support base area, whether the user is located within the user area, whether the user's upper body inclining forwardly, and whether the user's upper body inclining backwardly;

a control system electrically connected to the motor, the gait sensing device, the abdomen position sensing device, the shoulder position sensing device and the analysis module, and configured to perform an algorithmic program according to at least one of the characteristic messages and at least one preset parameter to obtain a calculation result, and then control the motor according to the calculation result, so that the electric walking aid is controlled to move.

2. The electric walking aid according to claim 1, wherein the non-contact manner is one of an imaged-based manner, a laser-based manner, an infrared-based manner and an ultrasonic-based manner.

3. The electric walking aid according to claim 1, wherein the at least one preset parameter is built in the control system or inputted by a therapist through an operation interface of the control system.

4. A method of controlling the electric walking aid of claim 1, the method comprising:

implementing, by the control system, a first support mode, a second support mode, an instant track moving mode, a stable feet mode and a posture correcting mode.

5. A method for controlling the electric walking aid according to claim 1 to implement the first support mode, comprising the steps of:

(a) under a condition that the electric walking aid is stopped moving and the user stands, obtaining the first distance d1 by the control system;

(b) comparing the first distance d1 and a neutral distance dzn set in the control system, to determine whether |d1-dzn| is greater than dε, wherein the dε is a tolerable error value set in the control system; when |d1-dzn| is larger than the dε, the control system controls the electric walking aid to move until the comparison result indicates that |d1-dzn| is smaller than the dε;

(c) controlling the electric walking aid by the control system to carry out one of the instant track dynamic support mode, the stable feet mode and the posture correcting mode.

6. A method for controlling the electric walking aid according to claim 1 to implement the second support mode comprising the steps of:

(a) shifting coordinates of a first neutral zone preset in the control system and indicative of the user's location, away from the user to form a second neutral zone which is forward of the first neutral zone;

(b) controlling the electric walking aid, by the control system, to move into the forward neutral zone;

(c) controlling the electric walking aid, by the control system, to execute one of the instant track dynamic support modes and the stable feet mode;

(d) shifting the coordinates of the second neutral zone, by the control system, close to the user when the electric walking aid is stopped moving and the user stands, so as to recovery the first neutral zone;

(e) controlling the electric walking aid, by the control system, to move to the neutral zone.

7. A method for controlling the electric walking aid according to claim 1 to implement the instant track moving mode comprising the steps of:

(a) presetting a neutral zone which indicatives of user's location in the control system;

(b) obtaining, by the control system, the first distance d1;

(c) comparing, by the control system, the first distance d1 with an upper limit dznu and a lower limit dznl of the neutral zone preset in the control system;

(d) when d1 is larger than dznu, controlling the motor to decelerate or rotate backwardly, so as to control the electric walking aid to move close to the user to reduce the distance between the electric walking aid and the user until d1<dznu and d1>dznl are satisfied; otherwise, when d1 is smaller than dznl, controlling the motor to accelerate or rotate forwardly to increase the distance between the electric walking aid and the user until d1<dznu and d1>dznl are satisfied;

(e) repeating the steps (b) through (d) until a training is ended or the electric walking aid is turned off.

8. A method for controlling the electric walking aid according to claim 1 to implement the instant track dynamic support mode comprising the steps of:

(a) presetting a neutral zone which indicatives of user's location in the control system;

(b) obtaining, by the control system, the first distance d1, max(d1-left, d1-right) and min(d1-left, d1-right) from the gait sensing device, and wherein a value of (d1-left) is a straight-line distance between a foot of the user's left leg and a specific point of a main structure, and a value of (d1-right) is a straight-line distance between a foot of the user's right leg and a specific point of a main structure;

(c) comparing, by the control system, the first distance d1 with an upper limit dznu and a lower limit dznl of the neutral zone preset in the control system, and comparing, by the control system, the second distance d2 with max(d1-left, d1-right) and min(d1-left, d1-right);

(d) when d1 is larger than dznu and d2 is between min(d1-left, d1-right) and max(d1-left, d1-right), controlling the motor to decelerate or rotate backwardly to slow the electric walking aid for reducing the distance between the electric walking aid and the user until the d2<dznu and d2>dznl are satisfied; otherwise, when d1 is smaller than dznl and d2 is between min(d1-left, d1-right) and max(d1-left, d1-right), controlling the motor to accelerate or rotate forwardly to speed up the electric walking aid for increasing the distance between the electric walking aid and the user until d2<dznu and d2>dznl are satisfied; and (e) repeating the steps (b) through (d) until a training is ended or the electric walking aid is turned off.

9. A method for controlling the electric walking aid according to claim 1 to implement the stable feet modemode comprising the steps of:

(a) presetting a neutral zone which indicatives of user's location in the control system;

(b) controlling, by the control system, the electric walking aid to keep static;

(c) according to the gait sensing device, determining, by the control system, whether the user's feet stably land, if no, returning to the step (b); if no, proceeding step (d);

(d) obtaining, by the control system, the first distance d1;

(e) comparing, by the control system, the first distance d1 and an upper limit dznu and a lower limit dznl of the neutral zone preset in the control system;

(f) when d1 is larger than dznu, controlling the electric walking aid to move close to the user until d1<dznu and d1>dznl are satisfied; otherwise when d1 is smaller than dznl, controlling the electric walking aid to move away from the user until d1 <dznu and d1 >dznl are satisfied; and (g) repeating the steps (c) through (f) until a walk training is ended or the electric walking aid is turned off.

10. The method according to claim 9, wherein the step (f) further comprises:

when d1 is larger than dznu, controlling the electric walking aid to move close to the user by a preset speed; and when d1 is smaller than dznl, controlling the electric walking aid to move away from the user by the preset speed.

11. The method according to claim 9, between the step (b) and the step (c), further comprising:

obtaining, by the control system, the user's step speed from the gait sensing device; and the step (f) further comprising:

when d1 is larger than dznu, controlling the electric walking aid to move close to the user by a speed equivalent to the user's step speed; and when d1 is smaller than dznl, controlling the electric walking aid, to move away from the user by the speed equivalent to the user's step speed.

12. A method for controlling the electric walking aid according to claim 1 to implement the stable feet mode comprising the steps of:

(a) presetting a neutral zone which indicatives of user's location in the control system;

(b) controlling the electric walking aid, by the control system, to keep static;

(c) according to the gait sensing device, determining, by the control system, whether the user's feet smoothly land; if no, returning to the step (b); if yes, proceeding step (d);

(d) obtaining, by the control system, the first distance d1, max, and min(d1-left, d1-right) from the gait sensing device, and wherein a value of (d1-left) is a straight-line distance between a foot of the user's left leg and a specific point of a main structure, and a value of (d1-right) is a straight-line distance between a foot of the user's right leg and a specific point of a main structure;

(e) comparing, by the control system, the first distance dl with an upper limit dznu and a lower limit dznl of the neutral zone preset in the control system, and comparing, by the control system, the second distance d2 with max(d1-left, d1-right) and min(d1-left, d1-right);

(f) when d1 is larger than dznu and d2 is between min(d1-left, d1-right) and max(d1-left, d1-right), controlling the electric walking aid to move close to the user until d2<dznu and d2>dznl are satisfied; otherwise, when d1 is smaller than dznl and d2 is between min(d1 -left, d1-right) and max(d1-left, d1-right), controlling the electric walking aid to move away from the user until d2<dznu and d2>dznl are satisfied; and (g) repeating the steps (c) through (f) until a walk training is ended or the electric walking aid is turned off.

13. The method according to claim 12, wherein the step (f) further comprises:

when d1 is larger than dznu and d2 is between min(d1-left, d1-right) and max(dl-left, d1-right), controlling the electric walking aid to move close to the user by a preset speed; and when d1 is smaller than dznl and d2 is between min(d1-left,d1-right) and max(d1-left,d1-right), controlling the electric walking aid, to move away from the user by the preset speed.

14. The method according to claim 12, between the step (b) and the step (c), further comprising:

obtaining, by the control system, the user's step speed from the gait sensing device; and the step (f) further comprising:

when d1 is larger than dznu, controlling the electric walking aid to move close to the user by a speed equivalent to the user's step speed; and when d1 is smaller than dznl, controlling the electric walking aid to move away from the user by the speed equivalent to the user's step speed.

15. A method for controlling the electric walking aid according to claim 1 to implement the posture correcting mode comprising the steps of:

(a) moving the electric walking aid in a manner the same as that of the instant track dynamic support mode or the stable feet mode;

(b) if the control system obtains the message associated with the user's body inclining forwardly, proceeding to step (c); otherwise, if the control system obtains the message associated with the user's body inclining backwardly, proceeding step (d);

(c) controlling the electric walking aid, by the control system, to move close to the user or decelerate, so as to support the user's upper body to change from a forward-inclined posture to an upright posture until the control system does not receive the message associated with the upper body inclining forwardly or backwardly;

(d) controlling the electric walking aid, by the control system, to move away from the user or accelerate, so as to support the user's upper body to change from a backward-inclined posture to the upright posture until the control system does not receive the message associated with the upper body inclining forwardly or backwardly.

* * * * *